US010954641B2

(12) United States Patent
Abeles

(10) Patent No.: US 10,954,641 B2
(45) **Date of Patent: *Mar. 23, 2021**

(54) BEACH EROSION INHIBITOR

(71) Applicant: Gary E. Abeles, Verona, NJ (US)

(72) Inventor: Gary E. Abeles, Verona, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/904,047

(22) Filed: Jun. 17, 2020

(65) Prior Publication Data

US 2020/0318305 A1 Oct. 8, 2020

Related U.S. Application Data

(63) Continuation-in-part of application No. 16/480,476, filed as application No. PCT/US2018/012781 on Jan. 8, 2018, now Pat. No. 10,718,095.

(60) Provisional application No. 62/451,394, filed on Jan. 27, 2017.

(51) Int. Cl.
*E02B 3/04* (2006.01)
*E02B 3/10* (2006.01)
*E02B 3/06* (2006.01)

(52) U.S. Cl.
CPC ..... *E02B 3/108* (2013.01); *E02B 3/06* (2013.01)

(58) Field of Classification Search
CPC ..... E02B 3/04
USPC ..... 405/15, 16, 302.4, 302.6
See application file for complete search history.

(56) References Cited

U.S. PATENT DOCUMENTS 2,474,786 A * 6/1949 Humphrey ..... E02B 3/06 405/30
3,280,569 A * 10/1966 Wosenitz ..... E02B 3/06 405/34
3,386,250 A * 6/1968 Katayama ..... E02B 3/129 405/33
3,653,216 A * 4/1972 Stickler, Jr. ..... E02B 3/04 405/33

(Continued)

FOREIGN PATENT DOCUMENTS

WO 20060031525 A2 3/2006

OTHER PUBLICATIONS

PCT International Search Report and Written Opinion for Appl No. PCT/US2018/012781, dated Apr. 27, 2018, 12 pages.

(Continued)

*Primary Examiner* — Benjamin F Fiorello
(74) *Attorney, Agent, or Firm* — Maine Cernota & Rardin

(57) ABSTRACT

An apparatus for impeding beach erosion includes a sea-facing barrier wall penetrated by large holes that allow water mixed with sand to enter the apparatus. Smaller holes provided in a rear wall allow the water to drain out after the entrained sand has settled. An underlying water reservoir fills with the drained water and gravitationally anchors the apparatus. The reservoir can be buried in the sand or placed on top thereof. The top of the barrier wall can be curved to direct water back toward the sea. The barrier wall can extend above the rear wall, and a backstop wall can form an additional sand-collecting chamber behind the rear wall. The walls can be made from plywood, metal, or plastic. Embodiments can be disassembled and/or folded for transport and storage. Internal reinforcing partition walls can extend between the barrier and rear walls. The apparatus can be further anchored by stakes.

20 Claims, 8 Drawing Sheets

(56) References Cited

U.S. PATENT DOCUMENTS 3,844,125 A * 10/1974 Williams, Sr. ..... E02B 3/04 405/33
4,129,006 A * 12/1978 Payne ..... E02B 3/06 405/31
4,367,978 A * 1/1983 Schaaf ..... E02B 3/04 405/21
4,479,740 A * 10/1984 Schaaf ..... E02B 3/04 405/30
4,711,598 A * 12/1987 Schaaf ..... E02B 3/06 405/21
4,818,141 A * 4/1989 Rauch ..... E02B 3/04 405/21
4,978,247 A * 12/1990 Lenson ..... E02B 3/06 405/15
5,102,257 A * 4/1992 Creter ..... E02B 3/06 405/25
5,176,468 A * 1/1993 Poole ..... E02B 3/04 405/111
5,405,217 A * 4/1995 Dias ..... E02B 3/126 405/25
5,564,369 A * 10/1996 Barber ..... A01K 63/006 119/221
5,655,851 A * 8/1997 Chor ..... E02B 3/06 405/15
D417,314 S * 11/1999 Smith, Jr. ..... D30/106
6,565,283 B1 * 5/2003 Hall ..... E02B 3/046 405/21
6,616,383 B2 9/2003 Janz
8,226,325 B1 * 7/2012 Pierce, Jr. ..... E02B 3/06 405/30
8,585,318 B1 * 11/2013 Walker ..... E02B 3/062 405/21
10,718,095 B2 * 7/2020 Abeles ..... E02B 3/12
2006/0056913 A1 * 3/2006 Herzog ..... E02B 3/04 405/25
2006/0159518 A1 * 7/2006 Cravens ..... B29C 41/386 405/16
2006/0275081 A1 * 12/2006 Medina Folgado ..... E02B 3/06 405/15
2009/0154996 A1 * 6/2009 Liner ..... E02B 3/04 405/35
2010/0310313 A1 * 12/2010 Kohlenberg ..... E02B 3/04 405/30
2016/0348327 A1 * 12/2016 Martin ..... E02D 17/202
2017/0342673 A1 * 11/2017 O'Sullivan ..... E02B 3/06

OTHER PUBLICATIONS

International Preliminary Report on Patentability for Appl No. PCT/US2018/012781, dated Jul. 30, 2019, 8 pages.

* cited by examiner

BEACH EROSION INHIBITOR

RELATED APPLICATIONS

This application is a continuation in part of U.S. application Ser. No. 16/480,476, filed on Jul. 24, 2019, now U.S. Pat. No. 10,718,095. Application U.S. Ser. No. 16/480,476 is a national phase application of PCT application PCT/US2018/012781, filed on Jan. 8, 2018. Application PCT/US2018/012781 claims the benefit of U.S. Provisional Application No. 62/451,394, filed Jan. 27, 2017. All of these applications are herein incorporated by reference in their entirety for all purposes.

FIELD OF THE INVENTION

The invention relates to apparatus and methods of reducing and reversing beach erosion, and more particularly to apparatus and methods for capturing and retaining entrained sand from ocean waves.

BACKGROUND OF THE INVENTION

The action of ocean waves on sandy beaches often leads to significant loss of shoreline due to beach erosion, as the waves repeatedly break onto the beach, causing sand to mix with the water and wash out to sea as the waves recede. Beach erosion is an issue of significant economic, esthetic, ecological, and practical concern, such that a considerable amount of effort and cost are expended each year in various attempts to protect and rebuild beaches.

Attempts to reduce or reverse beach erosion are generally directed to re-directing or blocking the energy of ocean waves before they reach the shoreline. One approach is to install an artificial breakwater, levee, or "groin" that blocks wave action and creates a region of low wave activity that is essentially an artificial harbor or cove. However, these structures are very large and heavy, expensive to build, and nearly impossible to remove or relocate as localized requirements evolve. Also, sand often tends to collect on one side of such a breakwater or levee, and be diminished on the other side, which may not be a desired effect.

Another approach is to submerge any of various types of barriers at or beyond the low tide level so as to partially block waves as they approach the shore and thereby reduce the energy with which the waves strike the beach. Some of these barriers include open tops or flow-through holes that encourage the sea water to pool long enough for any entrained sand to settle behind them and/or within their interiors. However, such barriers are also heavy, expensive to manufacture and install, and difficult to remove or relocate as needed.

Yet another approach is to deposit heavy chunks of concrete and/or other such materials, generally referred to as "riprap," below the waterline, which also has the effect of reducing wave energy and encouraging entrained sand to settle. While somewhat less expensive to manufacture and install than other forms of underwater barrier, riprap is virtually impossible to remove or relocate. Also, riprap can tend to become buried over time as sand is deposited, thereby reducing and eliminating its effectiveness.

The most common approach to reducing beach erosion that is implemented above the waterline is the planting of shoreline-compatible grasses that tend to stabilize the sand and protect it from wind erosion, and from the onrush of wave-driven water near the high tide mark. Such grasses can further serve to filter the ocean water as it recedes, so as to strain out and retain any sand that is entrained therein. However, shoreline-compatible grasses can be expensive, difficult, and time-consuming to establish, and grasses are not a viable solution when a sand beach is desired for recreational and/or other purposes.

What is needed, therefore, is an apparatus for impeding sand beach erosion and/or rebuilding sand beaches that is light in weight, easy and inexpensive to install, and easy to remove and relocate.

SUMMARY OF THE INVENTION

An apparatus for reducing sand beach erosion and/or rebuilding sand beaches is disclosed that is light in weight, easy and inexpensive to install, and easy to remove and relocate. A method for employing the disclosed apparatus is also disclosed.

Rather than attempting to reduce or block wave energy, the disclosed apparatus filters and removes entrained sand from the water that flows upward across the beach after a wave has broken. The disclosed apparatus is therefore configured for placement near or at the high tide level, where it is not subject to strong wave action. Accordingly, the disclosed apparatus can be relatively light in weight, and is therefore less expensive to construct, easier to install, and easier to remove and/or relocate than prior art devices. As sand is accumulated by the apparatus over time, the apparatus can easily be relocated seaward, so as to build and extend the beach to any desired degree.

The disclosed apparatus comprises a rigid or semi-rigid, sea-facing barrier wall that is penetrated by a plurality of "large" holes. The barrier wall is inclined in a land-ward direction so that when a wave breaks at some location seaward of the barrier wall, the resulting rush of water is directed upward across the front surface of the barrier wall, causing at least some of the water to enter through the large holes into an interior of the apparatus behind the barrier wall.

The apparatus further comprises a rear wall and, in embodiments, also one or two side walls, which create a semi- or fully enclosed interior within which the water that enters through the large holes forms a pool, allowing entrained sand to settle. Small holes, which are smaller than the large holes, are provided in the rear wall and, in embodiments, in at least one side wall, so that sea water that has pooled within the interior can slowly drain out of the interior and return to the ocean after the entrained sand has settled out. In embodiments, the small holes are offset from the base of the apparatus so as to encourage pooling of the water before it drains through the small holes.

The apparatus further includes an underlying water reservoir that collects and fills with water almost immediately after the apparatus is placed on the shore, thereby maintaining the apparatus in place. The underlying reservoir extends behind the rear wall of the apparatus, and includes an open region that is positioned to receive water as it flows out of the apparatus interior through the small holes. In some embodiments the overlying elements of the apparatus are attachable to and detachable from the underlying water reservoir. In other embodiments, the underlying water reservoir is inseparable from the remainder of the apparatus.

The weight of the underlying water reservoir when filled with water enables the apparatus to be constructed from materials that are light in weight, and/or enables the apparatus to be placed further toward the water within the tidal region, i.e. where it will encounter stronger waves, with reduced concern that the apparatus may be displaced by the force of the waves before the weight of accumulated sand within the interior of the apparatus is sufficient to hold the apparatus in place. In embodiments, the underlying water reservoir enables the apparatus to resist displacement by wave action without any need to use stakes or other mechanisms to anchor the apparatus in place. Other embodiments include an anchoring feature, such as anchor stakes that can be driven into the sand.

In some embodiments, the underlying water reservoir is configured for installation below the surface of the beach, so that the remainder of the apparatus extends from the level of the sand upward. In other embodiments, the underlying water reservoir is configured for placement onto the sand surface of the beach, and in some of these embodiments the underlying water reservoir extends in front of the barrier wall and is shaped so as to guide oncoming water up from the sand to the large holes of the barrier wall.

In embodiments, an upper end of the barrier wall is curved seaward, so that energetically flowing water that reaches the top of the barrier wall, resulting for example from large waves generated during a storm, is directed back toward the sea and does not flow over the barrier wall to the sand behind the apparatus. In some of these embodiments, the barrier wall extends above the rear wall, and in some of these embodiments a backstop wall extends from behind the rear wall to the barrier wall at a point above the top of the rear wall, so that an additional sand-collecting chamber is formed between the backstop wall and the rear wall. In these embodiments, the backstop wall is also penetrated by small holes, and the underlying reservoir extends beyond and behind the backstop wall, so that the open region of the underlying reservoir is positioned to receive water as it flows out of the apparatus interior through the small holes provided in the backstop wall.

Embodiments of the disclosed apparatus are constructed from plywood, from metal, from a plastic such as acrylic, from fiberglass, from particle board, which may include a laminated coating or veneer, from micro-lattice, from rigid foam, from Styrofoam, from graphene, and/or from any other suitable material. Embodiments can be easily disassembled and/or folded for transport and for storage at the deployed location or elsewhere. For example, embodiments can be folded and stored in place, and then erected when needed, such as in advance of an impending storm.

Embodiments that require enhanced structural strength include internal partition walls that extend between and reinforce the barrier wall and rear wall. The partition walls are penetrated by additional, interior large holes, so that water mixed with entrained sand that enters through the large holes provided in the barrier wall is able to flow downward through the interior large holes to the bottom of the apparatus interior. Embodiments further include at least one support wall within the underlying water reservoir that helps to support the weight of the overlying portions of the apparatus, especially as the interior of the apparatus fills with deposited sand. The support walls are penetrated by holes, so that water is able to flow freely within the reservoir.

While much of the description provided herein refers to "ocean" beaches, it should be noted that the disclosed invention is equally applicable to all sandy beaches that are exposed to wave action, including beaches adjacent to seas and large lakes.

A first general aspect of the present invention is an apparatus for reducing beach erosion. The apparatus includes a barrier wall having a top and a bottom, the barrier wall being inclined backward at an angle of at least 20 degrees from vertical, a first plurality of holes penetrating the barrier wall, a rear wall having a top and a bottom, the rear wall being located behind the barrier wall so that a chamber space is formed between and bounded by the barrier wall and the rear wall, a second plurality of holes penetrating the rear wall, the holes of the second plurality of holes being smaller in diameter than the holes of the first plurality of holes, the first plurality of holes being configured to allow water to flow through the barrier wall and into the chamber space, and the second plurality of holes being configured to allow water to flow through the rear wall out of the chamber space, and an underlying water reservoir located beneath the chamber space and fixed to the barrier wall and rear wall, the underlying water reservoir being configured to receive and be filled with the water that flows through the rear wall out of the chamber space.

In embodiments, the rear wall is inclined from vertical in a forward direction, so that the top of the rear wall is in contact with a rear surface of the barrier wall.

In any of the above embodiments, the thickness of the barrier wall can be between ¼ inch and two inches.

In any of the above embodiments, the barrier wall and the rear wall can be made from plywood, metal, fiberglass, particle board, micro-lattice, rigid foam, Styrofoam, graphene, and/or plastic.

Any of the above embodiments can further include a bottom panel extending from the bottom of the rear wall to the bottom of the barrier wall and forming a lower boundary of the chamber space.

In any of the above embodiments, the top of the barrier wall can be curved forward. In some of these embodiments, the rear wall is inclined from vertical in a forward direction, so that the top of the rear wall is in contact with a rear surface of the barrier wall, the curved top of the barrier wall extends above the top of the rear wall, the apparatus further includes a backstop wall having a bottom and a top, the bottom of the backstop wall is located behind the bottom of the rear wall, the top of the backstop wall extends to the rear surface of the barrier wall at a height that is above the top of the rear wall, a secondary chamber space being formed between the backstop wall and the rear wall, and at least some of the first plurality of holes penetrate the barrier wall at heights between the top of the rear wall and the top of the backstop wall.

In any of the above embodiments, the chamber space can be further bounded by at least one side wall. In some of these embodiments, at least one of the side walls is penetrated by a third plurality of holes.

In any of the above embodiments, the holes of the second plurality of holes can have diameters that are less than ¼ inch.

In any of the above embodiments, the holes of the first plurality of holes can have diameters that are between ¼ inch and 6 inches.

Any of the above embodiments ca further include a plurality of anchoring stakes configured to anchor the underlying water reservoir and/or the barrier wall to underlying sand.

In any of the above embodiments, the underlying water reservoir can be removably attached to the barrier wall and rear wall or inseparable from the barrier wall and rear wall.

In any of the above embodiments, the underlying water reservoir can include a curved front that is configured when placed on a sand surface of the beach to guide oncoming water to the barrier wall.

In any of the above embodiments, the barrier wall and front wall can be pivotable about their bottoms so as to overlap with each other in a substantially flat, folded configuration.

A second general aspect of the present invention is a method for reducing erosion of a sand beach that abuts a body of water, wherein the body of water generates waves that break onto the sand beach. The method includes providing the apparatus of any of the embodiments of the first general aspect, installing the apparatus on the sand beach in an orientation wherein the barrier wall faces the body of water, the apparatus being installed at a location above a highest location where the waves break, but in a location where water emitted by the breaking waves will reach the apparatus, allowing the underlying water reservoir to receive and be filled with the water that flows through the rear wall out of the chamber space, and allowing sand entrained in the water reaching the barrier wall to accumulate within the chamber space.

Some of these embodiments further include relocating the apparatus after sand has been accumulated therein, the accumulated sand being left behind as added beach sand. Some of these embodiments further include relocating the apparatus closer to the water, wherein the steps of allowing sand to accumulate and relocating the apparatus are repeated so as to progressively extend the beach toward the water.

Any of the above embodiments can further include burying the underlying water reservoir beneath a sand surface of the beach, so that the barrier wall extends upward from the sand surface.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is an apparatus for reducing sand beach erosion and/or rebuilding sand beaches. The apparatus is light in weight, easy and inexpensive to install, and easy to remove and relocate. A method for employing the disclosed apparatus is also disclosed.

Rather than attempting to reduce or block wave energy, the disclosed apparatus filters and removes entrained sand from the water that flows upward across the beach after a wave has broken. The disclosed apparatus is therefore configured for placement near or at the high tide level, where it is not subject to strong wave action. Accordingly, the disclosed apparatus can be relatively light in weight, and is therefore less expensive to construct, easier to install, and easier to remove and/or relocate than prior art devices. As sand is accumulated within the apparatus over time, the apparatus can easily be moved seaward, leaving the accumulated sand behind, to build and extend the beach to any desired degree.

Figure 1A:
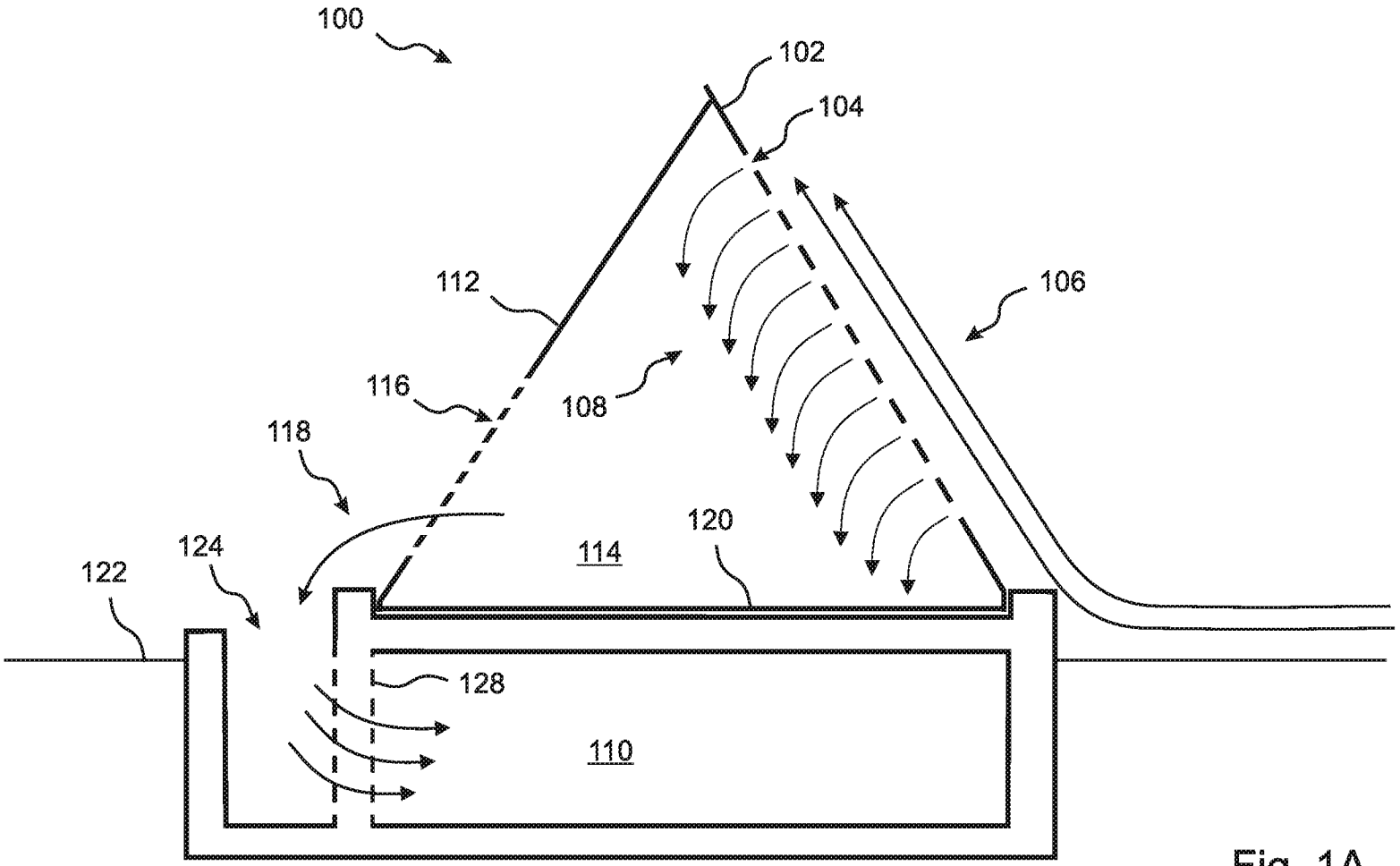
FIG. 1A is a cross-sectional view of a foldable embodiment of the present invention that is removably attached to an underlying water reservoir that is configured to be buried below the sand surface of a beach, shown in a deployed configuration interacting with flowing water.

With reference to FIG. 1A, the disclosed apparatus 100 comprises a rigid or semi-rigid, sea-facing barrier wall 102 that is penetrated by a plurality of "large" holes 104, which are typically between one half inch and 6 inches in diameter. The barrier wall 102 is inclined in a land-ward direction, in embodiments by an angle of at least 20 degrees from vertical. In the embodiment of FIG. 1A, the barrier wall 102 is inclined at an angle of 30 degrees from vertical. When a wave breaks at a location below the barrier wall, the resulting rush of water 106 is directed upward across the front surface of the barrier wall 102, causing at least some of the water 108 to enter through the large holes 104 into an interior 114 of the apparatus 100 behind the barrier wall 102.

The apparatus 100 further comprises a rear wall 112 and, in embodiments, also one or two side walls (312 in FIG. 3C), which create a semi- or fully enclosed interior 114 within which the water that enters through the large holes forms a pool that allows entrained sand to settle. "Small" holes 116 are provided in the rear wall 112 and, in embodiments, in at least one side wall 312, so that sea water that has pooled within the interior can slowly drain out 118 of the interior 114 and return to the ocean. These "small" holes are smaller than the "large" holes 102, and are typically less than one half inch in diameter. In embodiments the small holes are included in a section of metal or plastic screen that is installed in the rear wall and/or in one or more side walls 312. In the embodiment of FIG. 1A, the small holes 116 are offset from the bottom panel 120 of the apparatus, so as to encourage pooling of the water before it drains through the small holes 116. In various embodiments, this offset is between two inches and one foot.

The apparatus 100 further includes an underlying water reservoir 110 that collects and fills with water almost immediately after the apparatus 100 is placed on the shore 122, thereby maintaining the apparatus 100 in place. The underlying reservoir 110 extends behind the rear wall 112 of the apparatus 100, and includes an open region 124 that is positioned to receive water as it flows out of the apparatus interior 141 through the small holes 116. In the embodiment of FIG. 1A, the open region 124 is separated from the remainder of the underlying water reservoir 110 by a perforated wall 128 that provides enhanced support and rigidity.

In similar embodiments, the perforated wall 128 of the underlying water reservoir 110 is omitted.

Figure 2:
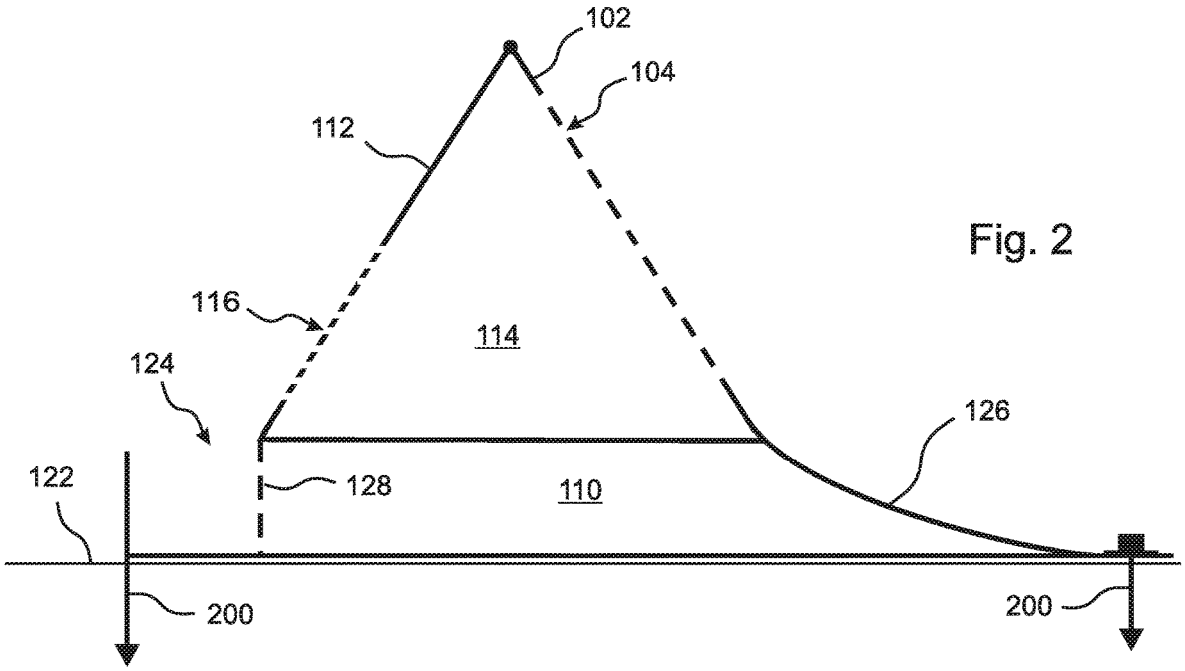
FIG. 2 is a cross-sectional view of an embodiment that is held in place by anchoring stakes and wherein the underlying water reservoir is integral with the remainder of the apparatus.

In the figure, the overlying elements of the apparatus 100 are attachable to and detachable from the underlying water reservoir 110. In other embodiments (see e.g. FIG. 2), the underlying water reservoir 110 is inseparable from the remainder of the apparatus 100.

The weight of the underlying water reservoir 110 when filled with water enables the apparatus 100 to be constructed from materials that are light in weight, and/or enables the apparatus 100 to be placed further toward the water within the tidal region, i.e. where it will encounter stronger waves, with reduced concern that the apparatus 100 may be displaced by the force of the waves before the weight of accumulated sand (308, FIG. 3B) within the interior 114 of the apparatus 100 is sufficient to hold the apparatus 100 in place. In the embodiment of FIG. 1A, the underlying water reservoir 110 enables the apparatus 100 to resist displacement by wave action without any need to use stakes or other mechanisms to anchor the apparatus in place. Other embodiments, such as the embodiment of FIG. 2, include an anchoring feature, such as anchor stakes 200 that can be driven into the sand 122.

Figure 1B:
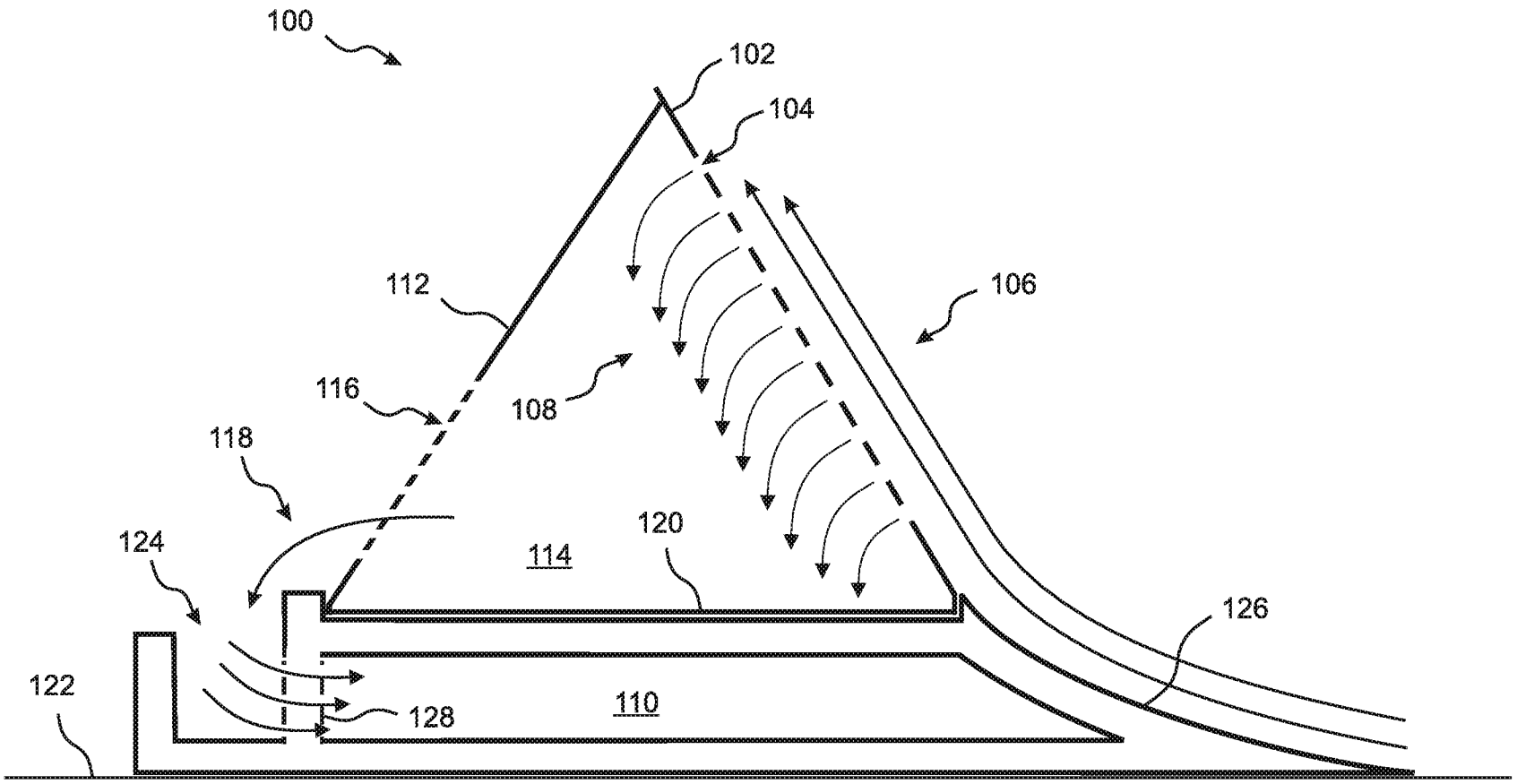
FIG. 1B is a cross-sectional view of an embodiment similar to FIG. 1B, but wherein the underlying water reservoir is configured for placement on top of the sand surface of the beach.

In the embodiment of FIG. 1A, the underlying water reservoir 110 is configured for installation below the surface 122 of the beach, so that the remainder of the apparatus 100 extends from the level of the sand 122 upward. In the embodiment of FIG. 1B, the underlying water reservoir 110 is configured for placement onto the sand surface 122 of the beach. The underlying water reservoir 110 in the illustrated embodiment extends in front of the barrier wall 102 and includes a curved shape 126 that guides oncoming water 106 up from the sand 122 to the large holes 104 of the barrier wall 102.

Embodiments of the disclosed apparatus are constructed from panels 102, 112, 120 any or all of which can range in thickness between one quarter of an inch and two inches in thickness. In some embodiments, any or all of the panels 102, 112, 120 are between one quarter of an inch and one inch in thickness. In other embodiments, any or all of the panels 102, 112, 120 are between 1/32 inch and 12 inches thick.

In various embodiments, any or all of the panels 102, 112, 120 are sheets made from plywood, from metal, from a plastic such as acrylic, from fiberglass, from particle board, which may include a laminated coating or veneer, from micro-lattice, from rigid foam, from Styrofoam, from graphene, and/or from some other suitable material. Some embodiments include a bottom panel 120, while others do not.

Figure 1C:
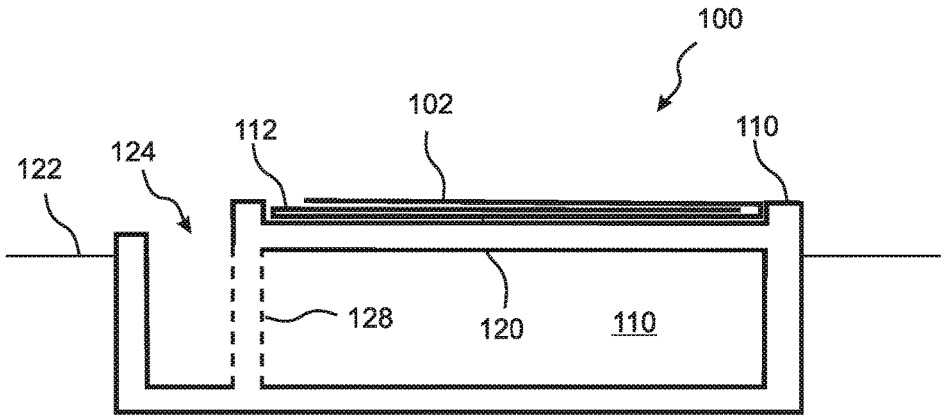
FIG. 1C is a cross-sectional view of the embodiment of FIG. 1A shown in a folded configuration.

Embodiments can be easily disassembled and/or folded for transport and for storage at the deployed location or elsewhere. With reference to FIG. 1C, embodiments can be folded and stored in place, and then erected when needed, such as in advance of an impending storm. In similar embodiments, the underlying water reservoir can also be folded for transport and storage.

While the disclosed apparatus 100 is not intended to withstand primary tidal and wave forces, it will generally be subject to winds, and to the residual energy of the water that flows up the front surface of the barrier wall 102. In the embodiments of FIGS. 1A-1C the weight of the underlying water reservoir 110, when filled with water, is sufficient to hold the apparatus 100 in place when subject to these forces. As an alternative, in addition to the underlying water reservoir 110, the embodiment of FIG. 2 also includes anchor stakes 200 that can be driven into the sand. This embodiment does not include a bottom panel 120. Instead, the underlying water reservoir 110 is integral with the remainder of the apparatus 100.

Figure 3A:
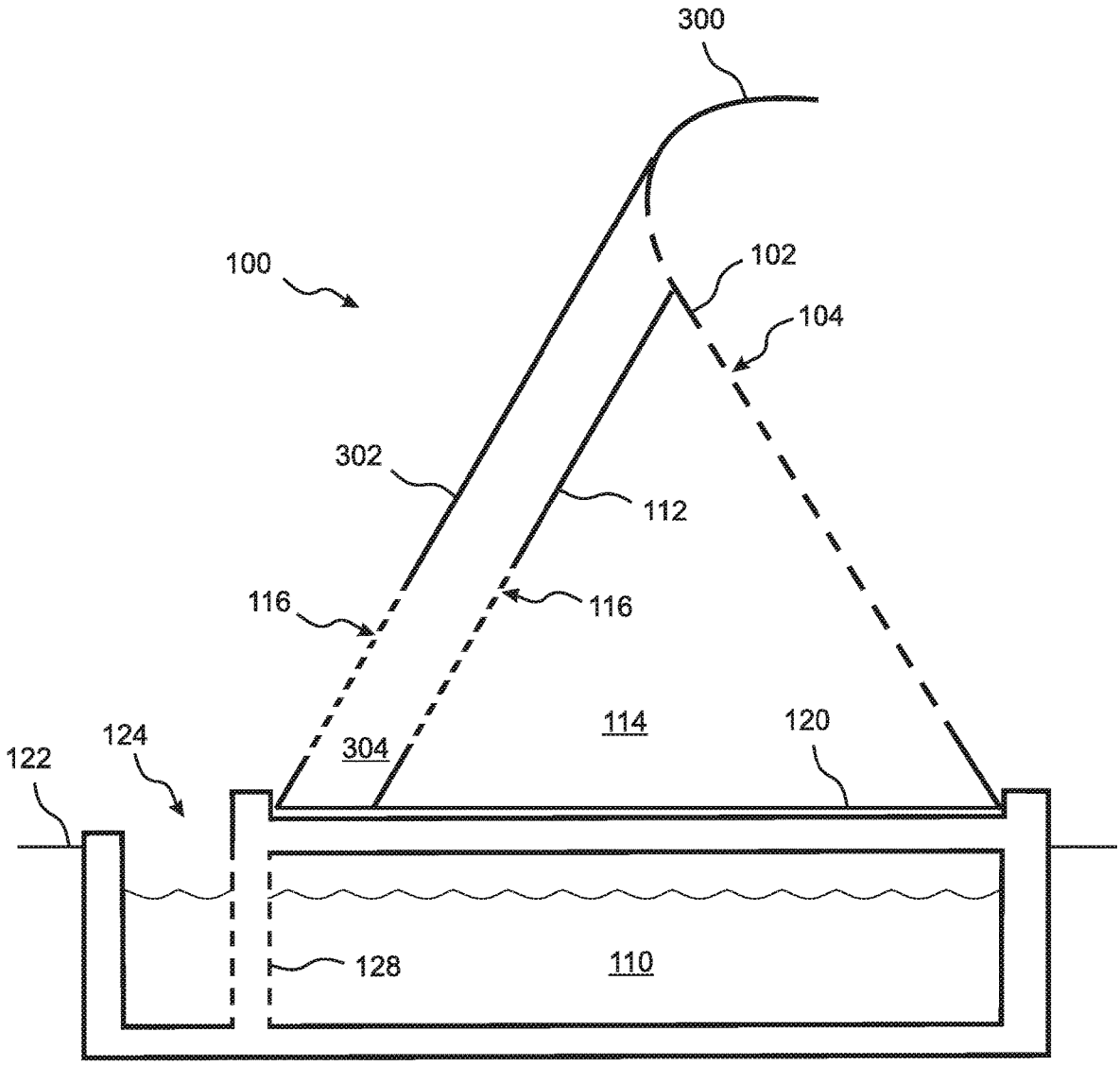
FIG. 3A is a cross-sectional view of an embodiment where the barrier wall includes a curved top extending above the rear wall, and the apparatus further includes a backstop wall.

With reference to FIG. 3A, in some embodiments the upper end 300 of the barrier wall 102 is curved seaward, so that energetically flowing water 106 that reaches the top 300 of the barrier wall 102, resulting for example from large waves generated during a storm, is directed back toward the sea and does not flow over the barrier wall 102 to the sand behind the apparatus. In the embodiment of FIG. 3A, the barrier wall 102 extends above the top of the rear wall 112, and a backstop wall 302 extends from behind the bottom of the rear wall 112 to a height on the barrier wall 102 that above the top of the rear wall 112, so that an additional sand-collecting chamber 304 is formed between the backstop wall 302 and the rear wall 112.

Figure 3B:
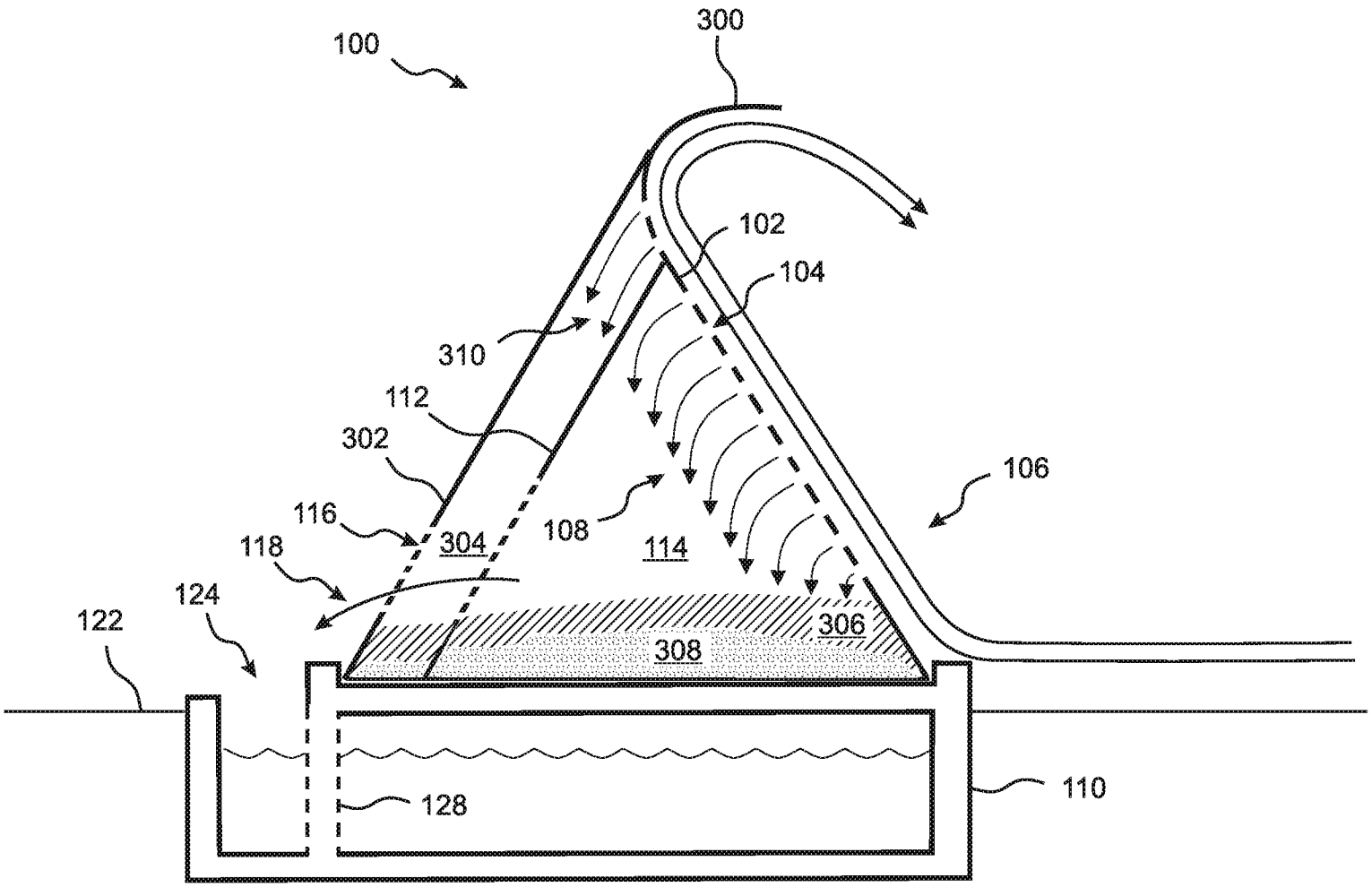
FIG. 3B is a cross-sectional view of the embodiment of FIG. 3A interacting with flowing water.

FIG. 3B illustrates the interaction between the apparatus 100 of FIG. 3A and water 106 flowing from a wave that has broken at a location seaward of the apparatus 100. As the water 106 flows up the front barrier 102 carrying entrained sand, some of the water 108 flows through the large holes 104 and into the interior 114 of the apparatus, where it forms a pool 306 that allows the entrained sand 308 to settle out of the water 306. For a strong surge of water 106, as is illustrated in FIG. 3B, some of the water 106 reaches the upper, curved portion 300 of the front barrier 102 and is directed seaward, so that it does not flow over the apparatus 100 and does not reach the sand behind the apparatus 100. Additional large holes are provided in the upper portion 300 of the front barrier 102, allowing additional water 310 to flow into an additional chamber 304 formed between the backstop wall 302 and the rear wall 112, where the water pools and allows entrained sand to settle. The pools of water then slowly drain out of the interior chambers 114, 304 through the small holes 116 provided in the rear wall 112 and backstop wall 302. If the underlying water reservoir has not already been filled, the water then flows into the open region 124 of the underlying water reservoir 110 and fills the underlying reservoir 110.

Figure 3C:
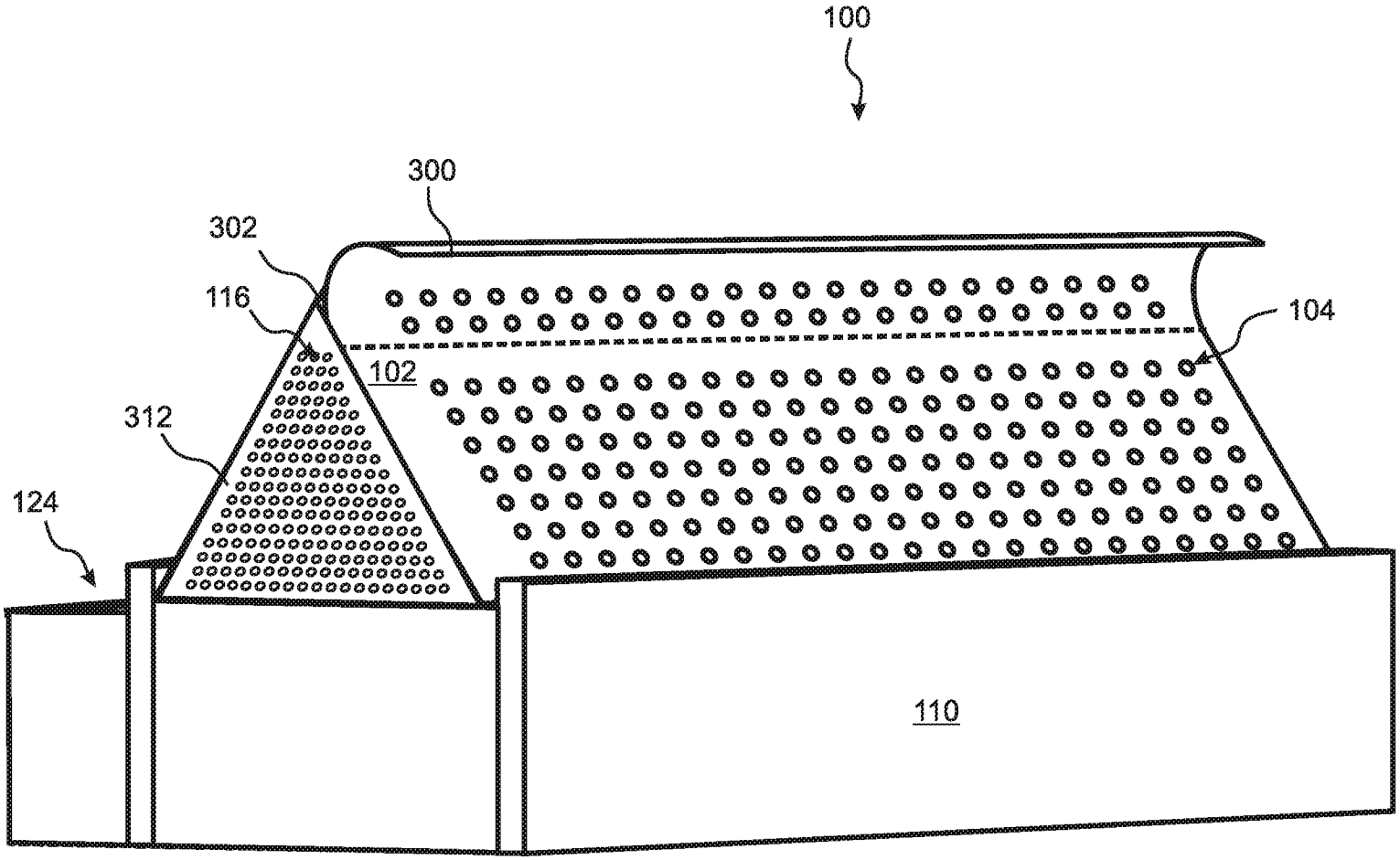
FIG. 3C is a front-left perspective view f of the embodiment of FIG. 3A.
Figure 3D:
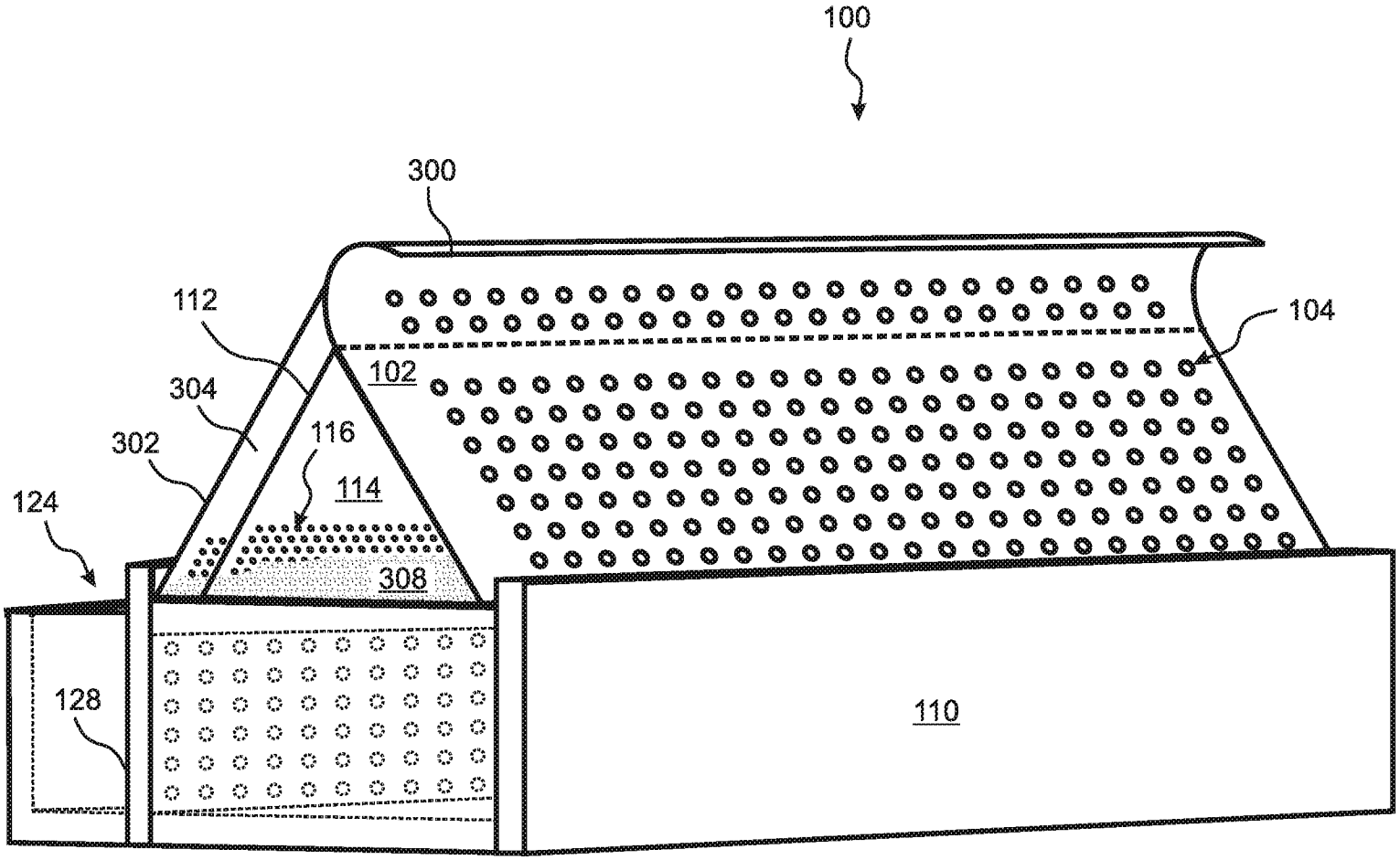
FIG. 3D is a view similar to FIG. 3C, with the left side walls rendered transparent so that interior structure can be seen.

A front-left perspective view of the embodiment of FIG. 3A is presented in FIG. 3C, and a similar view is presented in FIG. 3D, where the left side panel is made transparent so that interior structure is visible.

Figure 4:
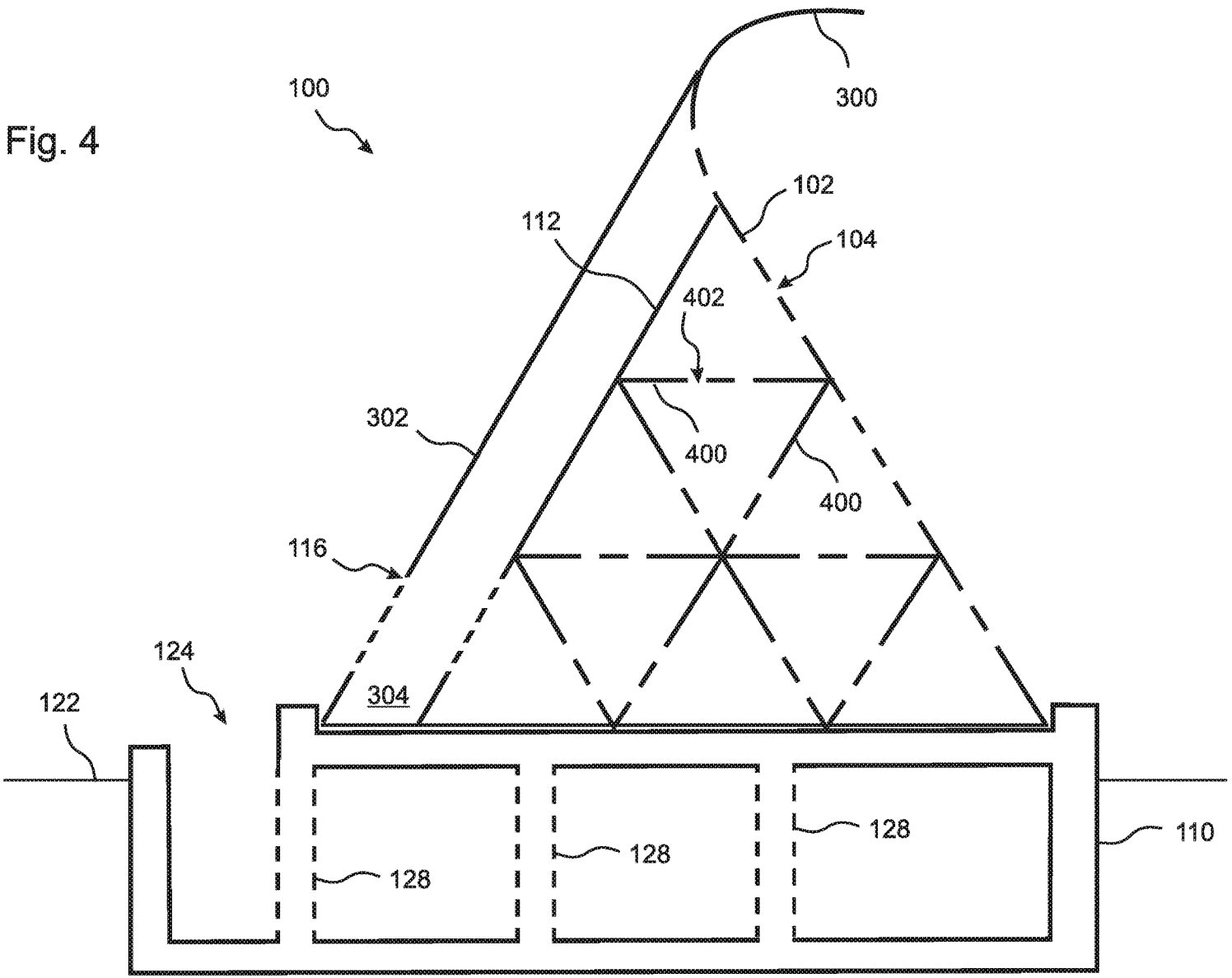
FIG. 4 is a cross-sectional view of an embodiment similar to FIG. 3A, but including structure-enhancing internal panels within its interior.

With reference to FIG. 4, some embodiments that require enhanced structural strength include internal partition walls 400 that extend between and reinforce the barrier wall 102 and rear wall 112. The partition walls 400 are penetrated by additional, interior large holes 402, so that water mixed with entrained sand that enters through the large holes 104 in the barrier wall 102 is able to flow downward through the interior large holes 402 to the bottom 120 of the apparatus interior 114. The embodiment of FIG. 4 also includes additional perforated walls 128 within the underlying water reservoir 110 that further enhance the structural strength.

While much of the description provided herein makes reference to "seawater" and "ocean" beaches, it should be noted that the disclosed invention is equally applicable to all sandy beaches that are exposed to wave action, including beaches adjacent to seas and large lakes.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

The invention illustratively disclosed herein suitably may be practiced in the absence of any element which is not specifically disclosed herein and is not inherently necessary. However, this specification is not intended to be exhaustive. Although the present application is shown in a limited number of forms, the scope of the invention is not limited to just these forms, but is amenable to various changes and modifications without departing from the spirit thereof. One of ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

What is claimed is:

1. An apparatus for reducing beach erosion, the apparatus including:

a barrier wall having a top and a bottom, the barrier wall being inclined backward at an angle of at least 20 degrees from vertical;

a first plurality of holes penetrating the barrier wall;

a rear wall having a top and a bottom, the rear wall being located behind the barrier wall so that a chamber space is formed between and bounded by the barrier wall and the rear wall;

a second plurality of holes penetrating the rear wall, the holes of the second plurality of holes being smaller in diameter than the holes of the first plurality of holes, the first plurality of holes being configured to allow water to flow through the barrier wall and into the chamber space, and the second plurality of holes being configured to allow water to flow through the rear wall out of the chamber space; and an underlying water reservoir located beneath the chamber space and fixed to the barrier wall and rear wall, the underlying water reservoir being configured to receive and be filled with the water that flows through the rear wall out of the chamber space.

2. The apparatus of claim 1 wherein the rear wall is inclined from vertical in a forward direction, so that the top of the rear wall is in contact with a rear surface of the barrier wall.

3. The apparatus of claim 1, wherein the thickness of the barrier wall is between ¼ inch and two inches.

4. The apparatus of claim 1, wherein the barrier wall and the rear wall are made from plywood, metal, fiberglass, particle board, micro-lattice, rigid foam, Styrofoam, graphene, and/or plastic.

5. The apparatus of claim 1, further comprising a bottom panel extending from the bottom of the rear wall to the bottom of the barrier wall and forming a lower boundary of the chamber space.

6. The apparatus of claim 1, wherein the top of the barrier wall is curved forward.

7. The apparatus of claim 6, wherein:

the rear wall is inclined from vertical in a forward direction, so that the top of the rear wall is in contact with a rear surface of the barrier wall;

the curved top of the barrier wall extends above the top of the rear wall;

the apparatus further includes a backstop wall having a bottom and a top;

the bottom of the backstop wall is located behind the bottom of the rear wall;

the top of the backstop wall extends to the rear surface of the barrier wall at a height that is above the top of the rear wall, a secondary chamber space being formed between the backstop wall and the rear wall; and at least some of the first plurality of holes penetrate the barrier wall at heights between the top of the rear wall and the top of the backstop wall.

8. The apparatus of claim 1, wherein the chamber space is further bounded by at least one side wall.

9. The apparatus of claim 8, wherein at least one of the side walls is penetrated by a third plurality of holes.

10. The apparatus of claim 1, wherein the holes of the second plurality of holes have diameters that are less than ¼ inch.

11. The apparatus of claim 1, wherein the holes of the first plurality of holes have diameters that are between ¼ inch and 6 inches.

12. The apparatus of claim 1, further comprising a plurality of anchoring stakes configured to anchor the underlying water reservoir and/or the barrier wall to underlying sand.

13. The apparatus of claim 1, wherein the underlying water reservoir is removably attached to the barrier wall and rear wall.

14. The apparatus of claim 1, wherein the underlying water reservoir is inseparable from the barrier wall and rear wall.

15. The apparatus of claim 1, wherein the underlying water reservoir includes a curved front that is configured when placed on a sand surface of the beach to guide oncoming water to the barrier wall.

16. The apparatus of claim 1, wherein the barrier wall and front wall can be pivoted about their bottoms so as to overlap with each other in a substantially flat, folded configuration.

17. A method for reducing erosion of a sand beach that abuts a body of water, wherein the body of water generates waves that break onto the sand beach, the method comprising:

providing the apparatus of claim 1;

installing the apparatus on the sand beach in an orientation wherein the barrier wall faces the body of water, the apparatus being installed at a location above a highest location where the waves break, but in a location where water emitted by the breaking waves will reach the apparatus;

allowing the underlying water reservoir to receive and be filled with the water that flows through the rear wall out of the chamber space; and allowing sand entrained in the water reaching the barrier wall to accumulate within the chamber space.

18. The method of claim 17, further comprising relocating the apparatus after sand has been accumulated therein, the accumulated sand being left behind as added beach sand.

19. The method of claim 18, wherein the apparatus is relocated closer to the water, the steps of allowing sand to accumulate and relocating the apparatus being repeated so as to progressively extend the beach toward the water.

20. The method of claim 17, further comprising burying the underlying water reservoir beneath a sand surface of the beach, so that the barrier wall extends upward from the sand surface.

* * * * *